US011572216B2

(12) United States Patent
Rodrigues et al.

(10) Patent No.: US 11,572,216 B2
(45) **Date of Patent: *Feb. 7, 2023**

(54) METHOD OF USING A BLANK WITH RAMP PANEL

(71) Applicant: Altria Client Services LLC, Richmond, VA (US)

(72) Inventors: Luiz Andre Rodrigues, Neuchatel (CH); Onesio Luis Thesing, Ecublens (CH)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/693,863

(22) Filed: Mar. 14, 2022

(65) Prior Publication Data

US 2022/0194653 A1 Jun. 23, 2022

Related U.S. Application Data

(60) Division of application No. 17/030,527, filed on Sep. 24, 2020, now Pat. No. 11,273,948, which is a (Continued)

(30) Foreign Application Priority Data

Dec. 29, 2016 (EP) ..... 16207308

(51) Int. Cl.
*B65D 5/02* (2006.01)
*B65D 5/42* (2006.01)
(Continued)

(52) U.S. Cl.
CPC ..... *B65D 5/02* (2013.01); *B65D 5/422* (2013.01); *B65D 5/5273* (2013.01);
(Continued)

(58) Field of Classification Search
CPC ..... B65D 5/02; B65D 5/422; B65D 5/5002; B65D 5/724; B65D 5/50; B65D 5/5004; B65D 5/5007; B65D 5/5273
See application file for complete search history.

(56) References Cited

U.S. PATENT DOCUMENTS 1,000,624 A 8/1911 Pexton
1,341,893 A 6/1920 Fitzgerald
(Continued)

FOREIGN PATENT DOCUMENTS

DE 202011050360 U1 9/2012
EP 0129114 A1 12/1984
(Continued)

OTHER PUBLICATIONS

Extended European Search Report issued in corresponding European Application No. 16207308.4, dated May 19, 2017.
(Continued)

*Primary Examiner* — Justin M Larson
(74) *Attorney, Agent, or Firm* — Harness, Dickey & Pierce, P.L.C.

(57) ABSTRACT

The method includes a blank with a lid and a top wall respectively connected to a first side and a second side of a bottom wall, a first sidewall connected to a first end of the bottom wall, and a ramp panel connected to the first sidewall along a first edge of the first sidewall, the method including first folding the ramp panel so that a second end of the ramp panel contacts the bottom wall, second folding the top wall into a first closed position over the bottom wall to at least partially form a package, the top wall defining an opening, at least part of the ramp panel and the first edge being viewable through the opening when the top wall is in the closed position, the lid in a second closed position at least partially covering the opening.

20 Claims, 2 Drawing Sheets

Related U.S. Application Data division of application No. 15/856,914, filed on Dec. 28, 2017, now Pat. No. 10,800,570, which is a continuation of application No. PCT/EP2017/083343, filed on Dec. 18, 2017.

(51) Int. Cl.

| | |
|---|---|
| ***B65D 5/52*** | (2006.01) |
| ***B65D 5/66*** | (2006.01) |
| ***B65D 47/08*** | (2006.01) |
| ***B65D 85/07*** | (2017.01) |
| ***B65D 5/72*** | (2006.01) |

(52) U.S. Cl.

CPC ..... *B65D 5/6602* (2013.01); *B65D 5/724* (2013.01); *B65D 47/08* (2013.01); *B65D 85/07* (2018.01); *B65D 2313/02* (2013.01)

(56) References Cited

U.S. PATENT DOCUMENTS

| | | | |
|---|---|---|---|
| 2,556,707 | A | 6/1951 | Rendall |
| 3,370,776 | A | 2/1968 | Krzyzanowski |
| 3,450,308 | A | 6/1969 | Schoenefeld |
| 3,750,930 | A | 8/1973 | Roth |
| 4,039,118 | A | 8/1977 | Kawaoka |
| 4,646,937 | A | 3/1987 | Doshi |
| 4,676,371 | A | 6/1987 | Byrne |
| 5,020,719 | A | 6/1991 | Roth et al. |
| 5,137,211 | A | 8/1992 | Summer et al. |
| D332,916 | S | 2/1993 | Barnskog |
| 6,168,073 | B1 | 1/2001 | Towle |
| 6,474,540 | B1 | 11/2002 | Barr et al. |
| 10,800,570 | B2 | 10/2020 | Rodrigues et al. |
| 11,273,948 | B2 * | 3/2022 | Rodrigues ..... B65D 5/02 |
| 2014/0097196 | A1 | 4/2014 | Koester et al. |
| 2017/0297802 | A1 | 10/2017 | Davis et al. |
| 2018/0170658 | A1 | 6/2018 | Snyder et al. |
| 2018/0170659 | A1 | 6/2018 | Snyder et al. |
| 2018/0186501 | A1 | 7/2018 | Rodrigues et al. |
| 2018/0334317 | A1 | 11/2018 | Slooff et al. |

FOREIGN PATENT DOCUMENTS

| | | | |
|---|---|---|---|
| JP | S6133965 | A | 2/1986 |
| JP | H1170056 | A | 3/1999 |
| WO | WO-0030955 | A1 | 6/2000 |

OTHER PUBLICATIONS

International Search Report and Written Opinion dated Mar. 23, 2018 in related PCT Application No. PCT/EP2017/083343.

International Preliminary Report on Patentability dated Jul. 11, 2019 in related PCT Application No. PCT/EP2017/083343.

* cited by examiner

METHOD OF USING A BLANK WITH RAMP PANEL

PRIORITY

This is a divisional of U.S. application Ser. No. 17/030,527, filed Sep. 24, 2020, which is a divisional application that claims priority to U.S. application Ser. No. 15/856,914, filed on Dec. 28, 2017, which claims priority to international application number PCT/EP2017/083343, filed on Dec. 18, 2017, and further claims priority under 35 USC § 119 to European patent application number 16207308.4, filed Dec. 29, 2016, the entire contents of each of which are incorporated herein by reference.

BACKGROUND

Field

Example embodiments relate to a container for consumer goods having improved structure for accessing the consumer goods. The container has a particular application as a container for aerosol-generating articles or elements of aerosol-generating articles.

Related Art

Aerosol-generating articles and other consumer goods can be packaged in container formed from folded laminar blanks. Consumer goods are commonly sold in hinge lid packs having a box for housing the consumer goods and a lid connected to the box about a hinge line extending across a wall of the container. Such packs are typically constructed from laminar cardboard blanks. In use, the lid is pivoted about the hinge line to open the pack and expose an access opening in the box, through which the consumer can gain access to the consumer goods held within the box.

In some cases, the packaging of the consumer goods within a container can make it difficult for the consumer goods to be removed through the access opening, in particular, especially upon the first opening of the container when the container may be relatively full.

SUMMARY

At least one example embodiment is directed toward a container for consumer goods.

In one embodiment, the container includes a box containing at least one first consumer good, the box having a top wall, a bottom wall, a front wall, a back wall, a first side wall, a second side wall and a ramp element depending from the first side wall and extending into the box, the at least one first consumer good being positioned between the ramp element and the top wall, the top wall defining an access opening extending over at least a part of the ramp element; and a lid flap connected to the box along a first hinge line, wherein the lid flap is movable between a closed position in which the access opening on the top wall is covered and an open position in which the access opening on the top wall is exposed and the at least one first consumer good is removable from the box.

In one embodiment, the ramp element extends from the first side wall to a position proximate the bottom wall.

In one embodiment, the ramp element includes a ramp panel extending across at least 50 percent of a width of the box from the first side wall.

In one embodiment, the ramp element depends from a top edge of the first side wall.

In one embodiment, the ramp element includes, a first panel depending from the top edge of the first side wall, the first panel being substantially coplanar with the top wall, and a ramp panel depending from the first panel and extending into the box towards the bottom wall, wherein the at least one first consumer good is positioned between the ramp panel and the top wall.

In one embodiment, the ramp element includes a ramp panel extending into the box at an angle of at least 30 degrees relative to the top wall.

In one embodiment, the access opening in the top wall is a cut out.

In one embodiment, upon first opening the container, the access opening is configured to be at least partially covered by a removable portion of the top wall, the removable portion being defined by one or more lines of weakness.

In one embodiment, the access opening in the top wall has a maximum width that is at least one third of a width of the top wall.

In one embodiment, the container further includes a closure structure for retaining the lid flap in the closed position.

In one embodiment, the closure structure includes a microsuction structure.

In one embodiment, the closure structure includes, a closure tab extending from an edge of the lid flap, and the box defines a slit for receiving the closure tab when the lid flap is in the closed position.

In one embodiment, the box and lid flap are formed from a single laminar blank.

In one embodiment, the container further includes at least one of an aerosol-generating article and an aerosol-generating article element within the box.

In one embodiment, the ramp element includes a ramp panel extending across at least 75 percent of a width of the box from the first side wall.

At least another example embodiment is directed toward a laminar blank.

In one embodiment, the laminar blank includes a box-defining portion including a top wall panel, a bottom wall panel, a front wall panel, a back wall panel, a first side wall panel, a second side wall panel and a ramp element depending from the first side wall panel, wherein the top wall panel defines an access opening extending from a first side edge; and a lid flap portion connected to the box-defining portion along a first hinge line, the laminar blank being configured to form a container by, forming a box from the box-defining portion, the box being defined by the top wall panel, the bottom wall panel, the front wall panel, the back wall panel, the first side wall panel, and the second side wall panel, the ramp element extending into the box, the box being configured to contain at least one first consumer good between the ramp element and the top wall, and forming a lid flap from the lid flap portion, the lid flap being movable between a closed position in which the access opening on the top wall is covered and an open position in which the access opening on the top wall is exposed and the at least one first consumer good is removable from the box.

BRIEF DESCRIPTION OF THE DRAWINGS

Example embodiments will now be described with reference to the accompanying drawings.

DETAILED DESCRIPTION

Figure 1:
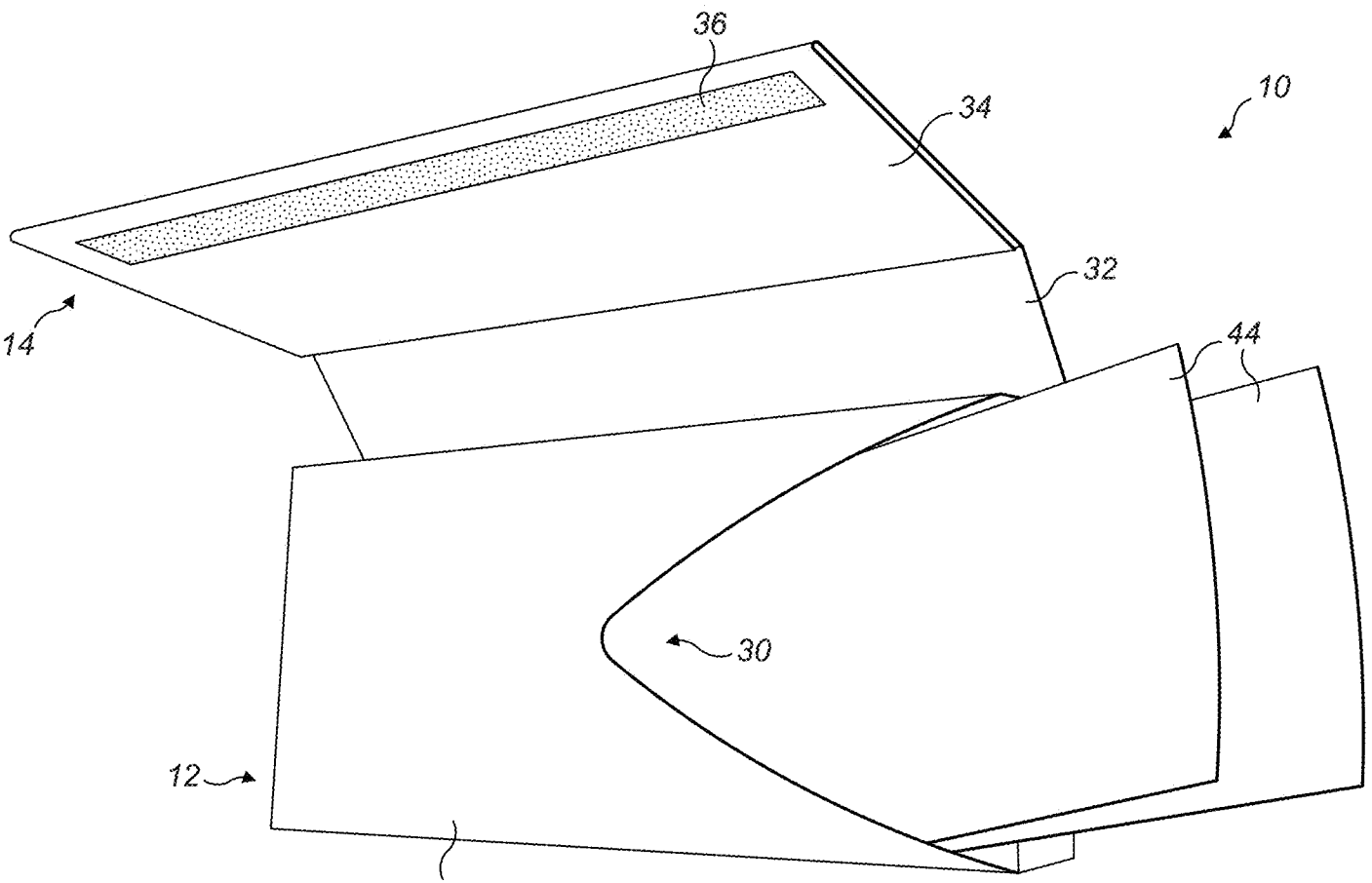
FIG. 1 is an illustration of a perspective view of a container with a lid flap in an open position and consumer goods are partially removed from the box, in accordance with an example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, and/or elements, but do not preclude the presence or addition of one or more other features, integers, steps, operations, elements, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, regions, layers and/or sections, these elements, regions, layers and/or sections should not be limited by these terms. These terms are only used to distinguish one element, region, layer or section from another region, layer or section. Thus, a first element, region, layer or section discussed below could be termed a second element, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Example embodiments include a container for consumer goods with a box housing one or more consumer goods and a lid flap connected to the box along a first hinge line. The box includes a box top wall, a box bottom wall, a box front wall, a box back wall, a first box side wall, a second box side wall and a ramp element depending from the first box side wall and extending into the box. The one or more consumer goods are positioned between the ramp element and the box top wall and the box top wall includes an access opening extending over at least a part of the ramp element. The lid flap is movable between a closed position in which the access opening on the lid top wall is covered and an open position in which the access opening on the lid top wall is exposed and the consumer goods are removable from the box.

In this document, the terms "side", "top", "bottom", "front", "back" and other terms used to describe relative positions of the elements of the container of the example embodiments refer to a container in an upright position, with the access opening at the top. When describing the container, these terms are used irrespective of the orientation of the container being described. The "bottom" of the container refers to the side of the container opposite the "top" of the container. The "back" of the container refers to the side towards which the lids swings open.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels. The term "flap" refers to a panel that depends from only one other panel.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container, in accordance with example embodiments. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a line of weakness from the adjacent wall. As an alternative, especially in a container having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional elements of the container in accordance with the example embodiments, for example to a reinforcing member provided in the form of an inner frame.

The term "line of weakness" is used herein to describe a portion of a surface of the container (or the blank from which the container is formed) wherein the structural strength of the material, from which the container (or blank) is formed has been weakened by any suitable technique, for example with respect to bending, folding or tearing along the line of weakness. For example, a line of weakness may be formed as a scoring line, a creasing line, an ablation line, or a perforation line. Lines of weakness can be created by removal of material, by displacement of material, by compression of material, by locally reducing the forces that hold the material together, such as by breaking fibres in a fibrous material, as well as by combinations of all the above. A line of weakness may be straight, curved, segmented or continuous or a combination thereof. In many instances, a line of weakness is used to assist in positioning a fold line in a blank. A line of weakness can also be used to strengthen the material in a direction perpendicular to the line of weakness, for example by compression. Further, a line of weakness can be used for decorative purpose.

The term "scoring line" is used to describe a line formed by partially cutting into the material of the blank. A scoring line may be formed by removing material from the blank (in which case the scoring line forms a groove or trough in the blank). As an alternative, a scoring line may be formed without removing any material from the blank, typically involving a partial sideways displacement and compression of material, caused by a knife with a non-zero thickness penetrating the material. The depth of the scoring line will be less than the thickness of the blank.

The term "creasing line" is used to describe a line formed by displacing a portion of the material vertical to the plane of the blank, and forming a groove or trough in the blank. The displacement may involve compression and typically involves the use of a compression tool, such as a roller. Alternatively, or in addition, the material in the creasing line may be displaced so as to at least partially protrude from the opposite side of the blank. Generally, no material is removed when a creasing line is formed.

The term "ablation line" is used to describe a line formed by removing material from a surface of the blank to a determined depth by way of ablation (for example, by way of a laser beam or a blade).

The term "perforated line" is used to describe a line or sequence of discrete holes or slots in the blank. The holes may be formed by pushing an object through the blank. This may result in material being removed from the blank, for example by punching. Alternatively, the holes can be created without removing material, and instead simply using the object to push the material outwardly from the center of the hole. As another alternative, the holes may be formed by way of a laser beam.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

The term "hinge line" is used herein to refer to a line about which the lid flap may be pivoted in order to open the container. A hinge line may be, for example, a fold line or a score line. The hinge line about which the lid flap is connected to the box may coincide with an edge of the container, or the hinge line may extend across a wall of the container at a position that is spaced apart from the edges.

The term "ramp element" is used herein to refer to a panel or arrangement of panels that extends into the interior of the box, from the first box side wall, and which provides a sloping surface to support the consumer goods. The consumer goods are able to slide or roll along the sloping surface provided by the ramp element towards the access opening in the box top wall, through which they can be removed. The ramp element thereby facilitates the removal of the consumer goods from the container.

Additionally, the ramp element may advantageously constrain the movement of the consumer goods within the box to a certain extent, which can help to ensure that the consumer goods are retained in an optimal condition. The constraint of movement of the consumer goods may also help ensure that the consumer goods are retained in an optimal orientation to be removed through the access opening by the consumer. Where the ramp element is formed of a sheet material having a certain degree of flexibility, such as a cardboard or paperboard material, the ramp element may change shape to a certain extent as consumer goods are removed from the container, and this change in shape may further improve the constraint of the movement of the consumer goods.

In the container according to example embodiments, the combination of the ramp element and the access opening in the box top wall (at least partially overlying the ramp element) therefore provides an improved structure for accessing the consumer goods housed within the box. The access opening in the box top wall provides a consumer with visibility of the consumer goods when the lid flap is in the open position, and it provides convenient access to grasp the consumer goods in order to remove them. However, by providing a ramp element to facilitate removal of the consumer goods through the access opening, by guiding the consumer goods through the access opening and out of the pack, it is possible to provide an access opening in the box top wall that is smaller than would be necessary in the absence of the ramp element. The consumer goods are therefore protected to a maximum extent possible by the box top wall.

The ramp element can advantageously be incorporated into a container without significantly affecting the construction of the other elements of the container. In particular, the ramp element does not adversely impact the structural rigidity of the container and the overall appearance of the container is not affected, since the ramp element is provided within the box.

As described above, the container according to the example embodiments may include a lid flap that is connected to the box along a hinge line. The lid flap is movable between a "closed" position in which the access opening on the box top wall is covered and an "open" position in which the access opening is exposed. The lid flap of the container of the example embodiments enables the access opening to be covered before use, and between uses, so that the consumer goods are protected and cannot inadvertently slide out from the box. The lid flap also ensures that the freshness of the consumer goods can be retained by closing the box to reduce ingress of air and moisture.

The ramp element of the container according to example embodiments depends from the first box side wall and extends into the interior of the box. In an embodiment, the ramp element extends from the first box side wall to a position proximate the box bottom wall, which corresponds to the wall opposite the box top wall that includes the access opening. In this context, the term "proximate" is used to mean that the ramp element extends to a position at the box bottom wall or adjacent to the box bottom wall, wherein a position is "adjacent" to the box bottom wall if the distance from that position to the box bottom wall corresponds to less than 10 percent of the distance between the box bottom wall and the box top wall.

Where the ramp element extends all of the way to the box bottom wall, the end of the ramp panel may be affixed to the box bottom wall, or it may contact the box bottom wall without being affixed. Advantageously, affixing the ramp panel to the box bottom wall increases the stability of the overall pack construction. In an embodiment, affixing the ramp panel to the box bottom wall allows for a precise positioning of the contact point of the ramp panel and the bottom wall. Affixing the ramp panel to the box bottom wall can also advantageously reduce the likelihood that a consumer good inadvertently slides underneath the ramp.

In an alternative embodiment, the ramp element may extend into the interior of the box, such that it remains separated from the box bottom wall.

In an embodiment, the ramp element extends from the top edge of the first box side wall. An end of the ramp element is therefore substantially level with the box top wall and the access opening, so that the consumer goods can move along the ramp element all of the way into the access opening. This enables the consumer goods to be readily grasped through the access opening without the need for the consumer to reach through the access opening into the box.

In an embodiment, the ramp element may include a ramp panel, which may provide the sloping surface along which the consumer goods can slide or roll towards the access opening. The ramp element may consist of a single panel providing the ramp panel, or the ramp element may comprise two or more connected panels including the ramp panel, as described in more detail below.

In an embodiment, the ramp panel extends across at least 50 percent of the width of the box, from the first box side wall. In another embodiment, the ramp panel extends across at least 75 percent of the width of the box. In another embodiment, the ramp panel extends more than halfway across the box, towards the second box side wall. In some embodiments, the ramp panel extends to a position proximate the second box side wall. In this context, the term "proximate" is used to mean that the ramp panel extends to a position at the second box side wall, or adjacent to the second box side wall, wherein a position is "adjacent" to the second box side wall if the distance from that position to the second box side wall corresponds to less than 10 percent of the distance between the first box side wall and the second box side wall.

In an embodiment, the ramp panel extends across substantially the full depth of the box, between the box front wall and the box back wall. This optimizes the sliding surface provided by the ramp panel. Additionally, this arrangement avoids significant gaps between the ramp panel and the box front wall or box back wall. This provides a more uniform appearance through the access opening and avoids consumer goods from becoming trapped next to the ramp panel, or underneath it. Alternatively, the ramp panel may have a depth that is less than the internal depth of the box, such that there is a gap between the ramp panel and at least one of the box front wall and the box back wall. In such embodiments, the ramp panel may have a depth that is at least sufficient to avoid the consumer goods from being held between the ramp panel, and it avoids the box top wall from becoming trapped within any gaps that are present between the ramp panel and the box walls.

In an embodiment, the ramp element includes a first panel depending from the top edge of the first box side wall and substantially coplanar with the box top wall, and a ramp panel extending from the first panel and extending into the box towards the box bottom wall, wherein the one or more consumer goods are positioned between the ramp panel and the box top wall.

In such embodiments, the ramp panel provides the sloping surface along which the consumer goods can be moved towards the access opening. The first panel provides a surface adjacent the first box side wall, against which the lid flap can close in the closed position. This means that the access opening does not extend all of the way to the top edge of the first box side wall. The provision of the first panel coplanar with the box top wall increases the contact between the lid panel and the box top wall when the lid panel is in the closed position, to provide a more effective closure over the access opening. The first panel may additionally improve the stability and strength of the container in the region of the access opening.

The first panel depends from the top edge of the first box side wall and may optionally be supported by one or more supporting flaps extending underneath the first panel. For example, there could be one or more supporting flaps depending from the front edge and the back edge of the first panel. In an embodiment, the supporting flaps of the first panel are folded substantially vertically towards the box bottom wall. The supporting flaps of the first panel may be affixed to the inner surface of the box front wall or box back wall, for example by use of an adhesive. In an alternative embodiment, the supporting flaps of the first panel may be arranged such that the bottom edges of the supporting flaps abut the box bottom wall to brace the first panel against the box bottom wall. A combination of bracing against the box bottom wall and affixing to a box front wall, box back wall or box side wall is also possible.

In example embodiments including a ramp element as defined above, with a first panel that is substantially coplanar with the box top wall, the width of the first panel may be less than 20 percent of the total width of the box, and may also be less than 10 percent.

In an alternative embodiment, the ramp element includes a first panel depending from the top edge of the first box side wall and positioned against the inner surface of the first box side wall, and a ramp panel depending from the first panel and extending into the box towards the box bottom wall, wherein the one or more consumer goods are positioned between the ramp panel and the box top wall. In such embodiments, the first panel is provided to offset the ramp panel from the box top wall. This can be of assistance when an increased space is required at the access opening in order to remove the consumer goods from the box.

In example embodiments including a ramp element as defined above, with a first panel that is positioned against the inner surface of the first box side wall, in an embodiment the height of the first panel is less than 50 percent of the height of the first box side wall, and in another embodiment less than 40 percent, and in yet another embodiment less than 30 percent.

Alternatively or in addition to a first panel, the ramp element may include an end panel depending from the ramp panel at the free end of the ramp panel, which corresponds to the end of the ramp panel that is opposite to the end that depends from the first panel or the first box side wall. In an embodiment, the end panel is configured so as to secure the position of the free end of the ramp panel within the box. This in turn enables the position and configuration of the ramp element to be retained.

In some example embodiments, the end panel may be affixed to the inner surface of one of the box walls, for example, the box bottom wall or the second box side wall. In other example embodiments, the end panel may be folded relative to the ramp panel, such that the free edge of the end panel abuts the inner surface of one of the box walls, for example, the box top wall. This type of configuration braces the ramp element against one of the box walls, to avoid significant movement of the ramp element, without the need for an adhesive.

In an embodiment, the ramp element may optionally include one or more sloping support flaps depending from the ramp panel and extending between the ramp panel and the box bottom wall. For example, the ramp element may include a sloping support flap depending from the front edge, or the back edge, or both, which extends from the ramp panel to the box bottom wall. The one or more sloping support flaps support the ramp panel and provide the ramp element with a more rigid, three dimensional structure. The one or more sloping support flaps also retain the position of the ramp panel and additionally close off any space beneath the ramp panel, such that the consumer goods are not able to pass underneath the ramp element.

In an embodiment, the one or more sloping support flaps may extend across the entire width of the ramp panel. Alternatively, in some embodiments, two or more sloping support flaps may be provided on one or each side of the ramp. These two or more sloping support flaps may brace against the box bottom wall or be affixed to the respective vertical walls or both, such that the resulting shape of the sloping panel is curved instead of straight. The arrangement of the two or more sloping support flaps may be different on each side of the ramp panel, such that the resulting shape of the ramp panel has a different profile at the front edge than at the back edge, providing a non-symmetric sloping surface.

In the example embodiments described above, the ramp panel of the ramp element may extend into the interior of the box in a substantially straight line, such that the ramp panel provides a substantially flat, planar sliding surface for the consumer goods. In an embodiment, the ramp panel extends towards the box bottom wall at an angle of at least 30 degrees, relative to the box top wall. In an alternative embodiment, the ramp panel of the ramp element may be curved towards the box bottom wall.

In an embodiment, the ramp panel extends into the box such that the free end of the ramp panel is provided within the box. In an alternative embodiment, the ramp panel may be folded or curved back on itself, such that the free end extends through the access opening. The ramp panel therefore extends underneath the consumer goods, around the end and back over the top, between the consumer goods and the box top wall. The consumer goods are therefore effectively enclosed within the ramp panel. The free end of the ramp panel projecting through the access opening can be pulled by the consumer to eject the consumer goods through the opening.

The ramp element may be provided with a low friction coating layer on at least a part of the top surface, for example, the top surface of the ramp panel. This facilitates the sliding of the consumer goods along the surface of the ramp element.

The top surface of the ramp element may optionally be printed with graphics or text, for example, one or more indicia to indicate the direction in which the consumer goods can be removed from the container.

In an embodiment, the access opening provided in the box top wall of the container provides the opening through which the consumer goods can be removed from the container. The access opening is provided over at least a part of the ramp element so that the consumer goods slide along the ramp element towards the access opening. The access opening may take any suitable form to enable convenient removal of the consumer goods within the box.

In an embodiment, the access opening is a cut out provided in the box top wall. The access opening is therefore incorporated into the container during the manufacturing process and is present when the lid flap is opened for the first time.

In an alternative embodiment, upon first opening the access opening, the opening is at least partially covered by a removable element which is at least partially removed by the consumer upon first opening of the lid flap, in order to gain access to the consumer goods. For example, upon first opening the container, the access opening may be at least partially covered by a removable portion of the box top wall defined by one or more lines of weakness. The lines of weakness may be configured to define a removable panel that is detachable from the box and is therefore intended to be fully removed by the consumer. In an alternative embodiment, the lines of weakness may be configured to define a removable panel that is removed from the access opening, but remains attached to the box along at least one edge. For example, the removable panel may be removed and folded away from the access opening. In such cases, it may be possible for the consumer to move the removable panel back into the original position over the access opening between uses.

In an alternative embodiment, the removable element may be in the form of a removable cover layer, such as a removable adhesive label, that is provided over the access opening. In contrast to the removable panel, which is an integral part of the box top wall, the removable cover layer is a separate element that is applied onto the box top wall to close the access opening. As with the removable panel described above, the removable cover layer may be configured to be detachable from the box. In an alternative embodiment, the removable cover layer may be configured such that it remains in place on the box. In such embodiments, the removable cover layer may be reclosed or resealed over the access opening between uses. For example, the removable cover layer may include a resealable adhesive that enables it to be sealed back over the access opening. In an alternative embodiment, the removable cover layer may be slidable relative to the box, such that it can be moved between a closed position over the access opening and an open position away from the access opening.

In example embodiments in which a removable cover layer is provided, the removable cover layer may be connected to the lid flap in such a way that it is removed from the access opening automatically when the lid flap is opened.

Alternatively or in addition, the removable cover layer may be attached to the lid flap such that the access opening is automatically reclosed by the removable cover layer when the lid flap is returned into the closed position.

In an embodiment, the access opening extends from the side edge of the box top wall coinciding with the top edge of the first box side wall. This arrangement of the access opening, with the edge of the access opening coinciding with the side edge of the box top wall, facilitates the sliding of the consumer goods out of the box through the access opening, since the consumer goods will not be blocked by any part of the box top wall. In such embodiments, the ramp element also can extend to the side edge of the box top wall to further facilitate the removal of the consumer goods through the access opening.

As described above, in some example embodiments, the ramp element may include a first panel that extends into the access opening, substantially coplanar with the box top wall.

The shape and size of the access opening may be varied, for example, depending upon the size and shape of the consumer goods contained within the box. In an embodiment, the maximum width of the access opening corresponds to at least one third of the width of the box, or at least one half of the width of the box.

In an embodiment, the depth of the access opening (corresponding to the dimension between the box front wall and the box back wall) decreases towards the second box side wall so that the access opening is largest at the side edge of the box top wall. For example, the access opening may be approximately V-shaped or semi-circular. This form of access opening helps to retain rigidity of the box, whilst still providing convenient access to the consumer goods.

In an example embodiment, the container includes a second access opening in the box top wall, wherein the second access opening is distant from the ramp element. Such a second access opening advantageously allows a consumer to reach through into the box and engage with the consumer goods, for example for inspection or to push the consumer goods towards the first access opening. In an embodiment, the second access opening has dimensions that are smaller than the consumer goods. The second access opening may be covered by transparent material, and the transparent material may be removable to allow tactile engagement with the consumer goods.

As described above, the container includes a lid flap that is connected to the box along a first hinge line and which is movable between a closed position and an open position. In an embodiment, the first hinge line extends along the bottom edge of the box back wall. In such embodiments, the lid flap typically includes a lid back wall and a lid top wall, which overlay the box back wall and the box top wall, respectively, when the lid flap is in the closed position. In an alternative embodiment, the first hinge line may extend along the top edge of the box back wall. In such embodiments, the lid flap includes a lid top wall but does not require a lid back wall. Advantageously, the lid flap may further include one or two lid side walls and a lid front wall. Where at least one lid side wall and a lid front wall is present, a cup shaped lid may be created. A cup shaped lid advantageously has increased rigidity and thus can protect the consumer goods and provide an effective closure of the access opening.

In the closed position, the lid flap covers the access opening in the box top wall. In an embodiment, the lid flap has a larger area than the access opening so that the access opening is fully covered and is not visible when the lid flap is in the closed position. In the closed position, the lid flap therefore may overlay an area of the box top wall surrounding the access opening as well as the access opening itself. The lid flap may cover substantially all of the box top wall, or it may cover only a part of the box top wall, provided the access opening is fully covered. In an embodiment, the container further includes closure structure for retaining the lid flap in the closed position. The closure structure may provide a resealable structure that retains a secure closure before the first opening of the container and also enables repeated opening and closing of the lid flap between uses. The closure structure may be provided on the lid flap, on the box walls that underlie the lid flap in the closed position, or both. In an embodiment, the closure structure is provided proximate at least one of the edges of the lid flap, to optimize the seal between the lid flap and the corresponding box wall or walls.

The closure structure may take any suitable form. In an embodiment, the closure structure includes a microsuction structure.

The term "microsuction structure" is used herein to refer to an article including a flexible material having a plurality of micro cavities on the material's external surface. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface. The microsuction structure can therefore provide an effective means for securing the lid flap in the closed position relative to the box.

The micro cavities may have a diameter of from 5 microns to 300 microns. The material may be formed of an expanded resin having a plurality of internal air bubbles. The material may be provided as a layer of a sheet-like article on the surface of the container. The layer may have a thickness of from 30 microns to 500 microns. The sheet-like article may include one or more additional layers, such as a layer for securing the material layer to the surface of the container.

In an embodiment, a microsuction structure is provided on a first surface of the lid flap, and a microsuction structure is provided on a corresponding first surface of the box. This can enhance the retention effect provided by the microsuction structures as they can attach to each other when the lid flap is in the closed position. In an alternative embodiment, the microsuction structure is provided on only one of the first surface of the lid flap or the first surface of the box.

In an alternative embodiment, the closure structure may include a resealable adhesive or a magnetised or magnetizable material in cooperation with one or several magnets provided between the contacting surfaces of the lid flap and the box.

Alternatively or in addition to the closure structure described above, the closure structure can include a closure tab extending from an edge of the lid flap and a corresponding slit in the box for receiving the closure tab when the lid flap is in the closed position. In an embodiment, the lid flap may be provided with a closure tab depending from the front edge of the lid top wall, which is received into a slit provided at the front edge of the box top wall.

In an embodiment, the container is formed from one or more folded laminar blanks. In an embodiment, the container is formed from a single laminar blank. The one or more laminar blanks may be formed from any suitable material or combination of materials including, but not limited to, cardboard, paperboard, plastic, metal, or combinations thereof. The box top wall may be at least partially formed of a substantially transparent material such that the consumer goods between the box top wall and the ramp element are visible and the consumer can observe the movement of the consumer goods along the ramp element as they are removed from the container.

In accordance with an embodiment, there is provided a laminar blank for forming the container, as described above, where the laminar blank includes: a box-defining portion including a box top wall panel, a box bottom wall panel, a box front wall panel, a box back wall panel, a first box side wall panel, a second box side wall panel and a ramp element depending from the first box side wall panel, wherein the box top wall panel includes an access opening extending from a first side edge; and a lid flap connected to the box-defining portion along a first hinge line. As described above in relation to the container, the access opening may be provided in the form of a cut out, or an arrangement of one or more lines of weakness.

In an example embodiment, the container contains one or more consumer goods within the box, which are supported between the ramp element and the box top wall. In an embodiment, the box contains one or more aerosol-generating articles or aerosol-generating article elements (which may also be vapor-generating articles and/or vapor-generating article elements). The consumer goods may be wrapped or sealed individually, or in groups. In an additional example embodiment, the consumer goods within the box are provided in one or more sealed pouches, which are filled with air or an inert gas to provide protection to the consumer goods. The sealed pouches are configured to slide along the surface of the ramp element to be removed through the access opening.

Through an appropriate choice of dimensions, the container may be designed to hold different types or numbers of consumer goods.

The example embodiments will now be further described, by way of example, with reference to the accompanying drawings.

FIG. 1 shows a container 10 in accordance with example embodiments, which is formed from a single laminar blank. The container 10 includes a box 12 and a lid flap 14 connected to the back of the box 12 along a hinge line 16 (shown in FIG. 2). The box 12 is a rectangular parallelepiped and includes a box top wall 18, a box bottom wall 20, a first box side wall 22, a second box side wall 24, a box front wall 26 and a box back wall 28. The box top wall 18 is provided with a V-shaped cut out 30 which extends from the top edge of the first box side wall 22 approximately halfway along the width of the box top wall 18. The cut out 30 provides the access opening of the box 12.

The lid flap 14 depends from the bottom edge of the box back wall 28 and includes a lid back wall 32 and a lid top wall 34. The lid back wall 32 and the lid top wall 34 are substantially the same size and shape as the box back wall 28 and the box top wall 18, respectively. The lid flap 14 is movable about the hinge line 16 between a closed position and an open position, as shown in FIG. 1. In the closed position, the lid back wall 32 and the lid top wall 34 overlay the box back wall 28 and the box top wall 18, respectively, and the access opening in the box top wall 18 is covered. In the open position, the lid flap 14 is pulled upwards and away from the box top wall 18 such that the access opening 30 is uncovered.

Figure 2:
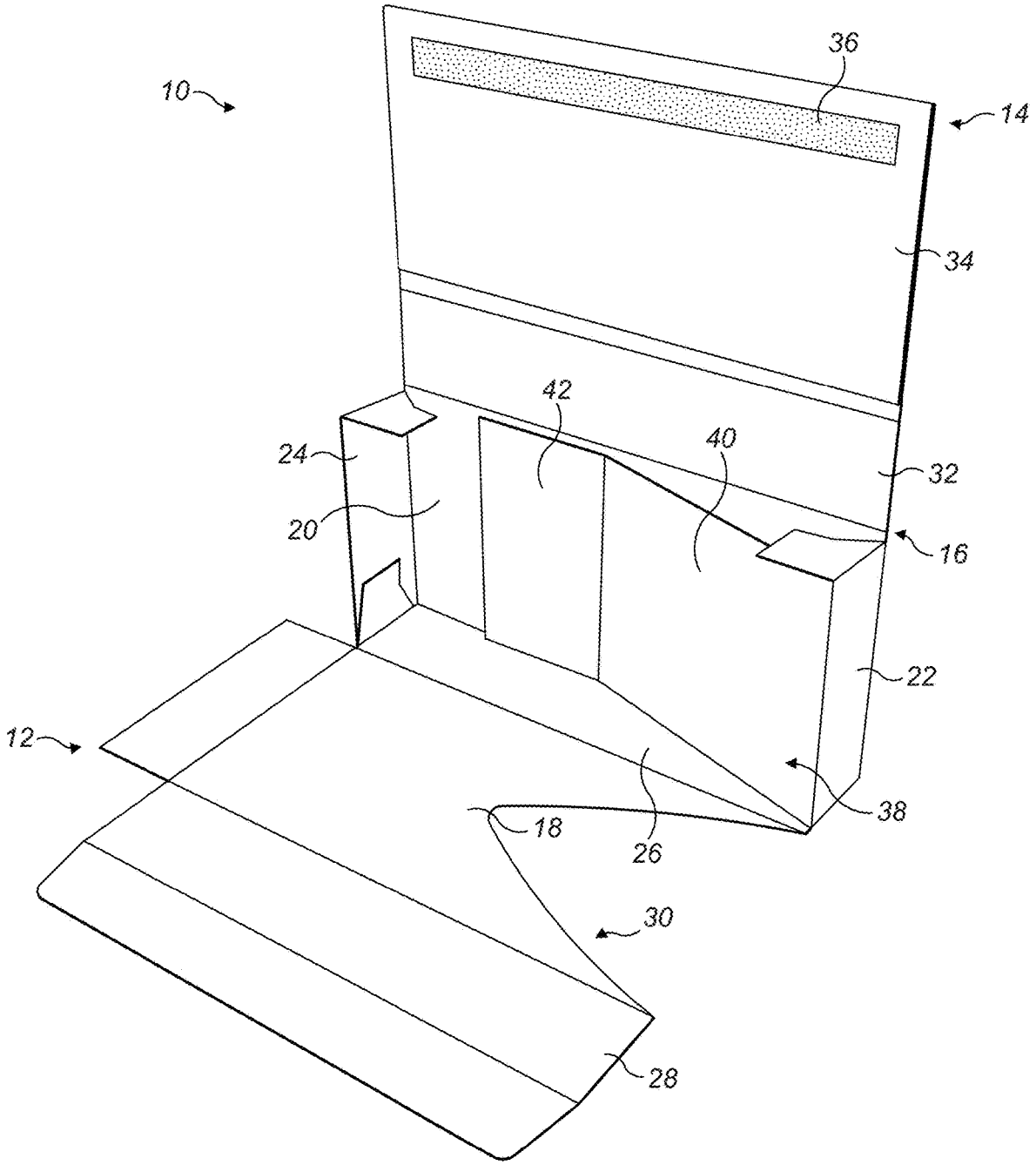
FIG. 2 illustrates the container of FIG. 1 with the box portion partially disassembled, in accordance with an example embodiment.

As shown in FIG. 2, the inner surface of the lid top wall 34 includes a microsuction structure 36 provided over an area of the surface, adjacent the front edge. The microsuction structure 36 is configured to engage with the outer surface of the box top wall 18 to retain the lid flap 14 in a closed position.

The container 10 further includes a ramp element 38 within the box 12. The ramp element 38 includes a ramp panel 40 depending from the top edge of the first box side wall 22 and an end panel 42 depending from the ramp panel 40. The ramp panel 40 is a substantially flat panel which extends from the top edge of the first box side wall 22 backwards into the box, to the box bottom wall 20. The end panel 42 overlays the box bottom wall 20 and is affixed to the inner surface of the box bottom wall 20 to retain the ramp element 38 in position.

The ramp panel 40 extends across approximately 60 percent of the width of the box from the first box side wall 22 towards the second box side wall 24, underneath the cut out 30 in the box top wall 18. The ramp panel 40 therefore extends a distance beyond the edge of the cut out 30 so that the end of the ramp panel 40 is not visible through the cut out 30. The depth of the ramp panel 40 and the end panel 42 correspond approximately to the internal depth of the box 12, which corresponds to the internal dimension between the box front wall 26 and the box back wall 28.

The box 12 contains one or more consumer goods sealed within pouches 44 which are held between the ramp element 38 and the box top wall 18. As shown in FIG. 1, when the lid flap 14 is in the open position, the pouches 44 are slidable along the ramp panel 40 towards the access opening provided by the cut out 30 in the box top wall 18. In use, a consumer can tilt the container 10 such that a pouch 44 slides towards the access opening 30 and can then grasp the pouch 44 and remove it from the box 12, through the access opening 30.

The specific embodiments and examples described above illustrate but do not limit the example embodiments. It is to be understood that other embodiments may be made, and the specific embodiments and examples described herein are not exhaustive.

The invention claimed is:

1. A method using a blank, the blank including, a lid and a top wall respectively connected to a first side and a second side of a bottom wall, a first sidewall connected to a first end of the bottom wall, and a ramp panel connected to the first sidewall along a first edge of the first sidewall, the method comprising:

first folding the ramp panel so that a second end of the ramp panel contacts the bottom wall;

second folding the top wall into a first closed position over the bottom wall to at least partially form a package, the top wall defining an opening, at least part of the ramp panel and the first edge being viewable through the opening when the top wall is in the first closed position; and third folding the lid into a second closed position over at least one portion of the top wall so that the lid at least partially covers the opening.

2. The method of claim 1, further comprising:

inserting at least one first consumer good into the package between the ramp panel and the top wall, at least a portion of the at least one first consumer good being viewable through the opening when the top wall is in the first closed position and the lid is in an opened position.

3. The method of claim 1, further comprising:

laying at least one first consumer good on the ramp panel, the at least one first consumer good being slideably removable from the package through the opening when the top wall is in the first closed position and the lid is in an opened position.

4. The method of claim 1, further comprising:

moving the lid from the second closed position into an opened position to expose the opening; and slideably removing at least one first consumer good from the package through the opening.

5. The method of claim 1, further comprising:

moving the lid from the second closed position into an opened position to expose the opening;

tearing away a removable portion from the top wall to expose the opening; and slideably removing at least one first consumer good from the package through the opening.

6. The method of claim 1, wherein the top wall is at least partially supported by the first edge when the top wall is in the first closed position.

7. The method of claim 1, wherein the top wall of the blank further includes a removable portion.

8. The method of claim 7, further comprising:

tearing away the removable portion from the top wall to expose the opening.

9. The method of claim 1, wherein the blank further includes a front wall and a back wall connected to respective sides of the top wall, the front wall directly connecting the top wall to the bottom wall, and the second folding further including folding the front wall and the back wall to be perpendicular to the top wall, an interior area of the package being at least partially defined by the top wall, the bottom wall, the front wall, the back wall and the first sidewall.

10. The method of claim 9, wherein the first folding folds the ramp panel so that the ramp panel is oriented diagonally, extending from the first edge to the bottom wall within the interior area, once the package is formed from the blank.

11. The method of claim 9, wherein the blank further includes a second sidewall connected to a third end of the bottom wall, and the method further comprises:

fourth folding the second sidewall to be perpendicular to the bottom wall, the interior area further being at least partially defined by the second sidewall.

12. The method of claim 1, wherein the second folding folds a front wall and a back wall to be perpendicular to the top wall, the front wall and the back wall being connected to respective sides of the top wall, an interior area of the package being at least partially defined by the top wall, the bottom wall, the front wall, the back wall, the first sidewall, and a second sidewall, the second sidewall being connected to a third end of the bottom wall.

13. The method of claim 9, wherein the lid of the blank includes a first lid panel and a second lid panel, and the third folding includes folding a first surface of the first lid panel to lay against a second surface of the back wall when the lid is in the second closed position.

14. The method of claim 13, wherein the lid of the blank includes a hinge between the first lid panel and the second lid panel.

15. The method of claim 13, wherein the blank includes a closure structure on a third surface of the second lid panel, the closure structure being configured to retain the second lid panel on the top wall when the lid is in the second closed position.

16. The method of claim 15, wherein the closure structure of the blank includes at least one of a microsuction structure or a closure tab.

17. The method of claim 1, wherein the lid includes a first lid panel and a second lid panel, and the third folding folds the lid so that the first lid panel is perpendicular to the bottom wall and the second lid panel is laying across the at least one portion of the top wall once the lid is in the second closed position.

18. The method of claim 1, wherein the blank further includes an end panel connected to the second end of the ramp panel, the first folding further including laying the end panel flat against the bottom wall while the second end contacts the bottom wall.

19. The method of claim 18, wherein the first folding folds the ramp panel so that the ramp panel is oriented diagonally within the package once the package is formed from the blank.

20. The method of claim 1, wherein the first folding folds the first sidewall so that the first sidewall is perpendicular to the bottom wall.

* * * * *